US012173590B2

(12) United States Patent
Brown et al.

(10) Patent No.: US 12,173,590 B2
(45) Date of Patent: Dec. 24, 2024

(54) ELECTRIC SUBMERSIBLE PUMP WITH IMPROVED GAS SEPARATOR PERFORMANCE IN HIGH VISCOSITY APPLICATIONS

(71) Applicant: Halliburton Energy Services, Inc., Houston, TX (US)

(72) Inventors: Donn J. Brown, Tulsa, OK (US); Ketankumar Kantilal Sheth, Tulsa, OK (US); Casey Laine Newport, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/610,826

(22) Filed: Mar. 20, 2024

(65) Prior Publication Data

US 2024/0218767 A1 Jul. 4, 2024

Related U.S. Application Data

(62) Division of application No. 17/491,952, filed on Oct. 1, 2021, now Pat. No. 11,965,401.

(51) Int. Cl.
*E21B 43/12* (2006.01)
*F04D 1/00* (2006.01)
(Continued)

(52) U.S. Cl.
CPC ..... *E21B 43/128* (2013.01); *F04D 1/00* (2013.01); *F04D 29/043* (2013.01); *F04D 29/22* (2013.01); *F04D 29/445* (2013.01)

(58) Field of Classification Search
CPC ..... E21B 43/128; E21B 43/38; F04D 13/10; F04D 29/445; F04D 29/448
See application file for complete search history.

(56) References Cited

U.S. PATENT DOCUMENTS 5,207,810 A 5/1993 Sheth
5,797,724 A 8/1998 Liu
(Continued)

OTHER PUBLICATIONS

Balasubramanian, Ravi et al., "Influence of Impeller Leading Edge Profiles on Cavitation and Suction Performance," Proceedings of the Second Middle East Turbomachinery Symposium, Mar. 17-20, 2012, 11 pages, Turbomachinery Laboratory, Texas A M University.
(Continued)

*Primary Examiner* — David E Sosnowski
*Assistant Examiner* — Jackson N Gillenwaters
(74) *Attorney, Agent, or Firm* — Conley Rose, P.C.; Rodney B. Carroll

(57) ABSTRACT

A downhole gas separator fluid mover assembly comprising a fluid mover having an inlet and an outlet, a separation device, a separation chamber, and a flow path separator located downstream of the fluid mover. The fluid mover comprising a centrifugal pump stage with an impeller and a diffuser moves production fluid comprising a high viscosity fluid portion and a gas portion to the separation device. The separation device produces a fluid motion that separates the gas phase from the liquid phase in response to the flow rate of production fluid from the fluid mover. A portion of the high viscosity fluid passes through the gas phase discharge port in response to the over-supply of high viscosity fluid to the liquid discharge port in response to the flow rate of the production fluid through the fluid mover.

18 Claims, 5 Drawing Sheets

(51) Int. Cl.

| | |
|---|---|
| ***F04D 29/043*** | (2006.01) |
| ***F04D 29/22*** | (2006.01) |
| ***F04D 29/44*** | (2006.01) |

(56) References Cited

U.S. PATENT DOCUMENTS

| | | | | |
|---|---|---|---|---|
| 6,676,366 | B2 | 1/2004 | Kao | |
| 6,854,517 | B2 | 2/2005 | Gay | |
| 6,893,207 | B2 | 5/2005 | Kao | |
| 7,409,997 | B2 | 8/2008 | Gay | |
| 8,801,360 | B2 | 8/2014 | Sheth | |
| 9,046,090 | B2 | 6/2015 | Kao | |
| 10,371,154 | B2 | 8/2019 | Jayaram | |
| 11,965,401 | B2 | 4/2024 | Brown et al. | |
| 2015/0044027 | A1 | 2/2015 | Van Dam | |
| 2015/0204336 | A1 | 7/2015 | McManus | |
| 2015/0354590 | A1 | 12/2015 | Kao | |
| 2016/0201444 | A1 | 7/2016 | Hardee | |
| 2018/0195375 | A1* | 7/2018 | Xiao | F04D 29/445 |
| 2020/0300265 | A1 | 9/2020 | Song | |
| 2020/0362649 | A1 | 11/2020 | Brown | |

OTHER PUBLICATIONS

Electronic Filing Receipt, Specification and Drawings for International Application No. PCT/US2021/053612, entitled "Electric Submersible Pump with Improved Gas Separator Performance in High Viscosity Applications," filed Oct. 5, 2021, 54 pages.

Foreign Communication from Related Application—International Search Report and Written Opinion of the International Searching Authority, International Application No. PCT/US2021/053612, dated Jun. 27, 2022, 12 pages.

Khoeini, Davood et al., "Enhancement of a Centrifugal Pump Performance by Simultaneous Use of Splitter Blades and Angular Impeller Diffuser," International Journal of Fluid Machinery and Systems, Apr.-Jun. 2018, vol. 11, No. 2, pp. 191-204, International Journal of Fluid Machinery and Systems.

Luo, Hongying et al., "Influence of Blade Leading-Edge Shape on Rotating-Stalled Flow Characteristics in a Centrifugal Pump Impeller," Applied Sciences, Aug. 14, 2020, vol. 10, No. 5635, 21 pages.

* cited by examiner

ELECTRIC SUBMERSIBLE PUMP WITH IMPROVED GAS SEPARATOR PERFORMANCE IN HIGH VISCOSITY APPLICATIONS

CROSS-REFERENCE TO RELATED APPLICATIONS

The present application is a divisional of and claims priority to U.S. patent application Ser. No. 17/491,952 filed Oct. 1, 2021, which is hereby incorporated by reference in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are produced or obtained from subterranean reservoir formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, completing the wellbore with completion equipment, installing production equipment at the wellsite, and pumping the hydrocarbons to the surface of the earth.

When performing subterranean operations, pump systems, for example, electric submersible pump (ESP) systems, may be used when reservoir pressure alone is insufficient to produce hydrocarbons from a well or is insufficient to produce the hydrocarbons at a desirable rate from the well. The presence of additional fluids, e.g., water, and gas, e.g., free gas, in a reservoir that migrates into the wellbore resulting in multiphase flow behavior of the fluid has a detrimental effect on pump performance and pump system cooling. Economic and efficient pump operations may be affected by gas laden fluid. For example, the presence of free gas in a pump causes a drop in pressure created within the pump stages resulting in reducing output of the pump. High concentrations of gas within a pump can create a condition commonly referred to as "gas lock", where gas is so prominent within the stages of the pump, the intended production liquid no longer reaches the surface. Separation of gas from the liquid phase of the fluid before entry into the pump stages improves pump performance, decreases pump vibration and reduces the operating temperature of the pump. An effective, efficient and reliable pump gas separation system is needed.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
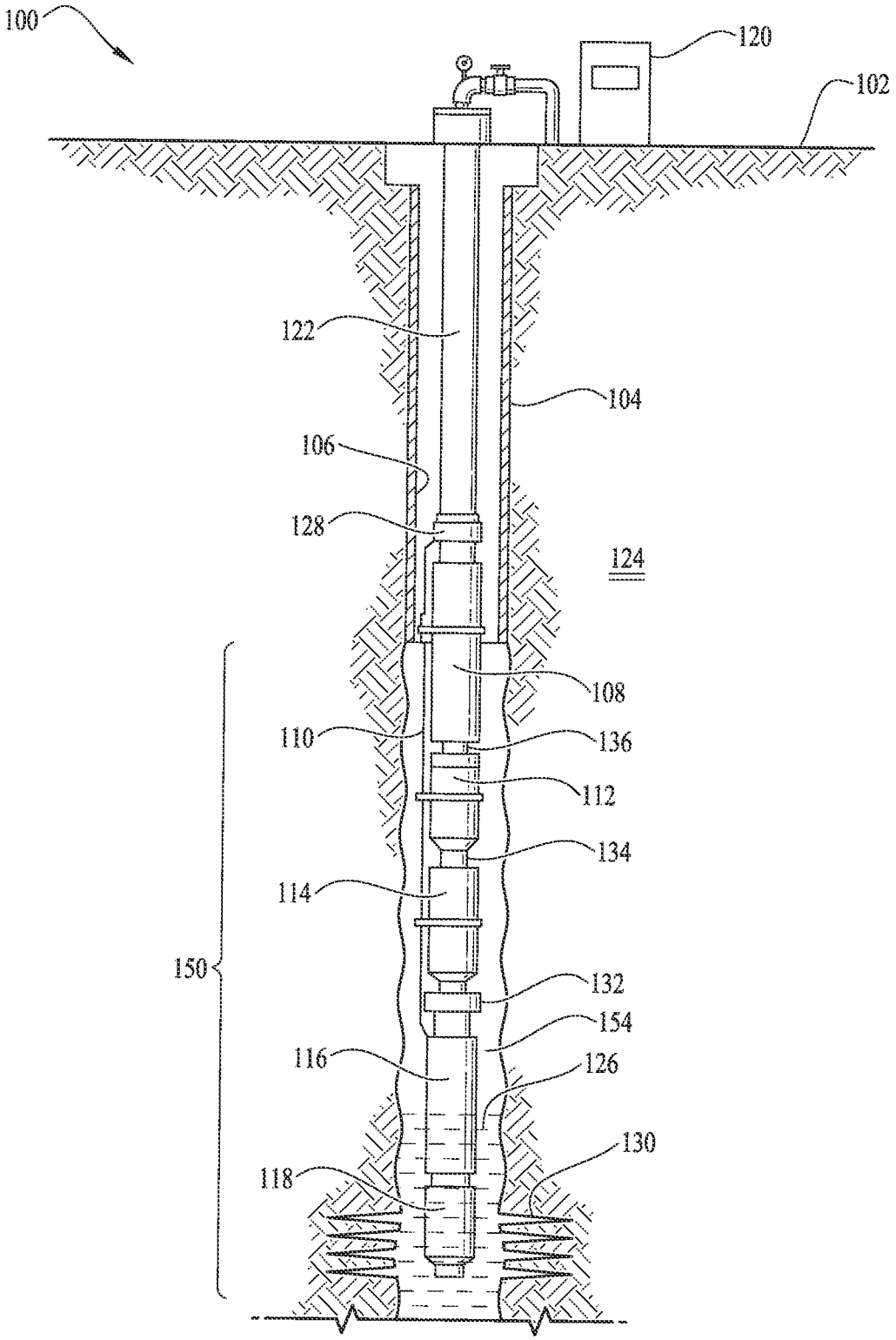
FIG. 1 is an illustration of an electric submersible pump assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" and "downhole" are directed counter to the direction of flow of well fluid, towards the source of well fluid. "Up" and "uphole" are directed in the direction of flow of well fluid, away from the source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Well fluid entering an electric submersible pump (ESP) assembly in a wellbore may be a mixture of liquid phase fluid and gas phase fluid. Liquid phase fluids can be a mixture of liquids like oil and water, or oil only, or oil and chemicals, used for well treatment. Similarly, gas phase fluids can be a mixture of a variety of natural gases produced from a subterranean formation. Sometimes well fluids can be liquid phase fluid only; at other times a mixture of liquid phase fluid and gas phase fluid; and at yet other times gas phase fluid only (e.g., during a so called transient "gas slug" event). In some contexts, well fluid may be referred to as production fluid.

Gas entering an ESP assembly can cause various difficulties for a centrifugal pump of the ESP assembly. In an extreme case, the centrifugal pump assembly may become gas locked and become unable to pump fluid. In less extreme cases, the centrifugal pump assembly may experience harmful operating conditions when transiently passing a slug of gas. When in operation, the centrifugal pump assembly rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the centrifugal pump assembly may heat up rapidly and undergo significant wear, shortening the operational life of the centrifugal pump assembly, thereby increasing operating costs due to more frequent change-out and/or repair of the centrifugal pump assembly. In some operating environments, for example in some horizontal wellbores, gas slugs that persist for at least 10 seconds are repeatedly experienced. Some gas slugs may persist for as much as 30 seconds or more.

To mitigate these effects of gas in an centrifugal pump assembly, a gas separator can be placed upstream of a centrifugal pump assembly to separate gas phase fluid from the liquid phase fluid. However, when the liquid phase fluid comprises high viscosity fluid, e.g., viscosity above 500 cp, the typical fluid movers in gas separators, e.g., an auger, may be ineffective. Typically, a gas separator receives a production fluid from an annulus formed between the outside of the ESP assembly and the inside of the wellbore, separates the gas phase fluid from the liquid phase fluid, feeds the liquid phase fluid to the centrifugal pump through a crossover sub, and expels the gas phase fluid to the annulus through an exit port on the crossover sub. An effective gas separator can over-supply the centrifugal pump with the liquid phase through the crossover sub which results in a portion of the separated liquid phase exiting the exit port with the gas phase fluid.

Desirably, the fluid mover on an effective gas separator can provide a high flowrate of the production fluid with a high percentage of gas phase to the separator portion to separate and exhaust the gas phase and to over-supply the centrifugal pump with the liquid phase. A high viscosity production fluid, however, can reduce the already limited flowrate produced by an auger to an undesirably low flowrate by reducing the pumping performance due to friction loss. Too low of a flowrate of high viscosity fluids through the gas separator may inhibit the separation of gas from the production fluid and introduce an undesirable volume of gas phase fluid into the centrifugal pump assembly. An effective gas separator with a high flowrate for production fluids comprising high viscosity fluids is desirable.

One solution for a high flowrate gas separator can include a fluid mover comprised of an impeller and diffuser. In an embodiment, the use of an impeller and diffuser combination as a fluid mover in a gas separator can produce higher flowrates than an auger. An impeller designed for a production fluid with a normal range of viscosity, e.g., below 500 cp, may be ineffective with high viscosity fluids due to the high friction losses. The addition of a gas phase within the high viscosity fluid may further inhibit the performance of an impeller designed for production fluids with a normal range of viscosity. An impeller and diffuser expressly designed to be effective for production fluids with high viscosity fluids can improve the performance of a gas separator in the presence of high viscosity production fluids.

An impeller moves production fluid by imparting rotational energy into the production fluid within the impeller through a series of vanes. The vanes are generally a curvilinear shape and separate an inner chamber of the impeller into a plurality of flow chambers. The production fluid enters into each of flow chambers through an entrance, e.g., an inlet of the flow chamber, adjacent the hub, e.g., near the shaft, of the impeller. The rotational motion of the impeller moves the production fluid from the entrance, near the hub, through the chamber to an exit of the flow chamber along the outside edge of the impeller. The inner chamber of an impeller can generally be divided into 6 or more, e.g., 6, 7, 8, or 9, flow chambers by the same number of vanes. The higher number of vanes improves the pumping performance of a typical centrifugal pump with production flow with a gas phase liquid. However, the higher number of vanes, e.g., more than 6, also reduces the cross-sectional flow area perpendicular to the flow path through each flow chamber creating higher surface area and higher friction losses resulting in poor performance with viscous fluids. The better gas phase fluid pumping with the higher number of vanes along with poor liquid phase fluid pumping performance with high viscous fluids in a conventional impeller having 6 or more flow chambers can reduce the production fluid flow through the gas separator and promote a gas lock condition within the centrifugal pump. An impeller and diffuser combination designed for production fluids comprising a high viscosity fluid phase with a gas fluid phase can improve the performance of a gas separator.

One solution for a high flowrate fluid mover within a gas separator can include an impeller with a large cross-sectional flow area perpendicular to the flow path. In an embodiment, the flow area through an impeller and diffuser can be increased by using a reduced number of vanes. The number of vanes within the inner chamber of the impeller and diffuser can be reduced to 1, 2, 3, or 4 vanes. The flow chambers created by the reduced number of vanes can have a significantly larger cross-sectional flow area perpendicular to the flow path and reduce the surface area accordingly. For example, an impeller and diffuser with 3 flow chambers, e.g., 3 vanes, can approximately double the cross-sectional flow area through each flow chamber compared to an impeller with 6 flow chambers, e.g., 6 vanes, and reduce surface area by half. The increase in cross-sectional flow area and reduced surface area can result in an increase in volumetric flow rate. Similarly, the increase in cross-sectional flow area of the flow chamber and reduced surface area can result in a proportional reduction in friction losses from viscous fluids. The reduced number of vanes can also increase the inlet area of the impeller and diffuser for each flow chamber. The reduction in friction losses at the inlet can be proportional to the increase in inlet area. Additional changes to the geometry of profiling the leading edge of impeller and diffuser vanes can reduce the friction losses at the inlet. Conventionally, the leading edges of impeller and diffuser vanes are blunt or partially circular, as this is a profile that is most easily manufactured. To improve performance in the presence of high viscosity production fluid, while more difficult and costly to manufacture, the leading edges of impeller and diffuser vanes may be given a different profile better adapted to high viscosity fluids. For example, the leading edge of the impeller and diffuser vanes at the inlet can include a parabolic shape to reduce the friction losses of a blunt shape. In addition, the inlet skirt of the impeller can be reduced or removed to increase the cross-sectional area of each inlet to each flow chamber. The increase in cross-sectional flow area perpendicular to the flow path through the flow chambers and the increase in cross-sectional flow area at each inlet for each flow chamber of the impeller and diffuser can improve the performance of the impeller and diffuser with production fluids that comprise a viscous liquid phase fluid and a gas phase fluid.

The present disclosure teaches an increased flow rate gas separator with an increased cross-sectional area fluid mover to reduce the friction losses from the viscous fluids. In an embodiment, the fluid mover comprises one or more impeller and diffuser combinations. Each impeller includes an increasedI cross-sectional flow area perpendicular to the flow path from a reduced number of vanes relative to conventional fluid movers in gas separators. For example, the impeller may have 3 vanes and 3 corresponding flow paths and flow chambers. The number of vanes in each diffuser may be the same or different than the number of vanes in the impeller. For example, the diffuser may have 4 vanes and 4 corresponding flow chambers compared to the 3 vanes of the impeller. The impeller and diffuser may have additional geometry changes to the leading edge of the vanes at the inlet to reduce the friction losses through the fluid mover of the gas separator. The increase in cross-sectional flow area and reduced surface area through the fluid mover, e.g., impeller and diffuser, reduces the friction losses from viscous fluids and increases the flow rate through the gas separator.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming, but would nevertheless be a routine undertaking for those of ordinary skill in the art having the benefit of the present disclosure.

FIG. 1 illustrates a well site environment 100, according to one or more aspects of the present disclosure. While well site environment 100 illustrates a land-based subterranean environment, the present disclosure contemplates any well site environment including a subsea environment. In one or more embodiments, any one or more components or elements may be used with subterranean operations equipment located on offshore platforms, drill ships, semi-submersibles, drilling barges and land-based rigs.

In one or more embodiments, well site environment 100 comprises a wellbore 104 below a surface 102 in a formation 124. In one or more embodiments, a wellbore 104 may comprise a nonconventional, deviated, horizontal or any other type of wellbore. Wellbore 104 may be defined in part by a casing string 106 that may extend from a surface 102 to a selected downhole location. Portions of wellbore 104 that do not comprise the casing string 106 may be referred to as open hole.

In one or more embodiments, various types of hydrocarbons within production fluids 126 may be pumped from wellbore 104 to the surface 102 using an electric submersible pump (ESP) pump assembly 150 disposed or positioned downhole, for example, within, partially within, or outside casing 106 of wellbore 104. ESP assembly 150 may comprise a centrifugal pump assembly 108, an electric cable 110, a gas separator fluid mover assembly 112, a seal unit assembly 114, an electric motor 116, and a downhole sensor package 118. In an embodiment, the centrifugal pump assembly 108 may comprise one or more centrifugal pump stages, each centrifugal pump stage comprising an impeller mechanically coupled to a drive shaft of the centrifugal pump assembly and a corresponding diffuser held stationary by and retained within the centrifugal pump assembly (e.g., retained by a housing of the centrifugal pump assembly). In an embodiment, the centrifugal pump assembly 108 may not contain a centrifugal pump but instead may comprise a rod pump, a progressive cavity pump, or any other suitable pump system or combination thereof. The ESP assembly 150 may be referred to as a downhole artificial lift assembly. In some contexts, the centrifugal pump assembly 108 may be referred to as a production pump assembly or as a primary pump.

The centrifugal pump assembly 108 may transfer pressure to the production fluid 126 or any other type of downhole fluid to pump or lift the fluid from downhole to the surface 102 at a desired or selected pumping rate. Centrifugal pump assembly 108 couples to the gas separator fluid mover assembly 112. Gas separator fluid mover assembly 112 couples to the seal unit 114, e.g., seal unit assembly, which couples to the electric motor 116. The electric motor 116 may be coupled to a downhole sensor package 118. In one or more embodiments, an electric cable 110 is coupled to the electric motor 116 and to a controller 120 at the surface 102. The electric cable 110 may provide power to the electric motor 116, transmit one or more control or operation instructions from controller 120 to the electric motor 116, or both.

The rotational motion produced by the electric motor 116 can be transferred to the centrifugal pump assembly 108 through a series of shafts mechanically coupled together. A first drive shaft of the electric motor 116 may mechanically couple to a second drive shaft in the seal unit 114. The second drive shaft may mechanically couple to a third drive shaft of the gas separator fluid mover assembly 112. The third drive shaft may mechanically couple to a fourth drive shaft of the centrifugal pump assembly 108. Drive shafts may have external teeth or grooves (e.g., splines) and may be mechanically coupled to a proximate drive shaft by a spline coupling or hub coupling featuring mating interior teeth that engage with the teeth or grooves of the drive shafts.

The first drive shaft may transmit or communicate rotation of the electric motor 116 to the second drive shaft of the seal unit 114, from the second drive shaft to the third drive shaft of the gas separator fluid mover assembly 112, and from the third drive shaft to the fourth drive shaft of the centrifugal pump assembly 108. The third drive shaft can provide rotational energy and power to one or more fluid movers, e.g., impellers, of the gas separator fluid mover assembly 112. The fourth drive shaft can provide rotational energy and power to one or more impellers of the centrifugal pump assembly 108. The electric motor 116 may be mechanically coupled to the seal unit 114 by a first coupling 132. The seal unit 114 may be mechanically coupled to the gas separator fluid mover assembly 112 by a second coupling 134. The gas separator fluid mover assembly 112 may be mechanically coupled to the centrifugal pump assembly 108 by a third coupling 136.

In one or more embodiments, production fluid 126 may be a multi-phase wellbore fluid comprising one or more hydrocarbons. For example, production fluid 126 may comprise a gas phase fluid and a liquid phase fluid from a wellbore or reservoir in a formation 124. In one or more embodiments, production fluid 126 may enter the wellbore 104, casing 106 or both through one or more perforations 130 in the formation 124 and flow uphole within an annulus 154 to one or more intake ports of the ESP assembly 150. The annulus 154 is defined as the space between an outside of the ESP assembly 150 and an inside surface of the casing 106 or an inside surface of the wellbore 104. The centrifugal pump assembly 108 may transfer pressure to the fluid 126 by adding kinetic energy to the fluid 126 via centrifugal force and converting the kinetic energy to potential energy in the form of pressure. In one or more embodiments, centrifugal pump assembly 108 lifts production fluid 126 to the surface 102. In some contexts, the production fluid 126 may be referred to as fluid or reservoir fluid.

Figure 2:
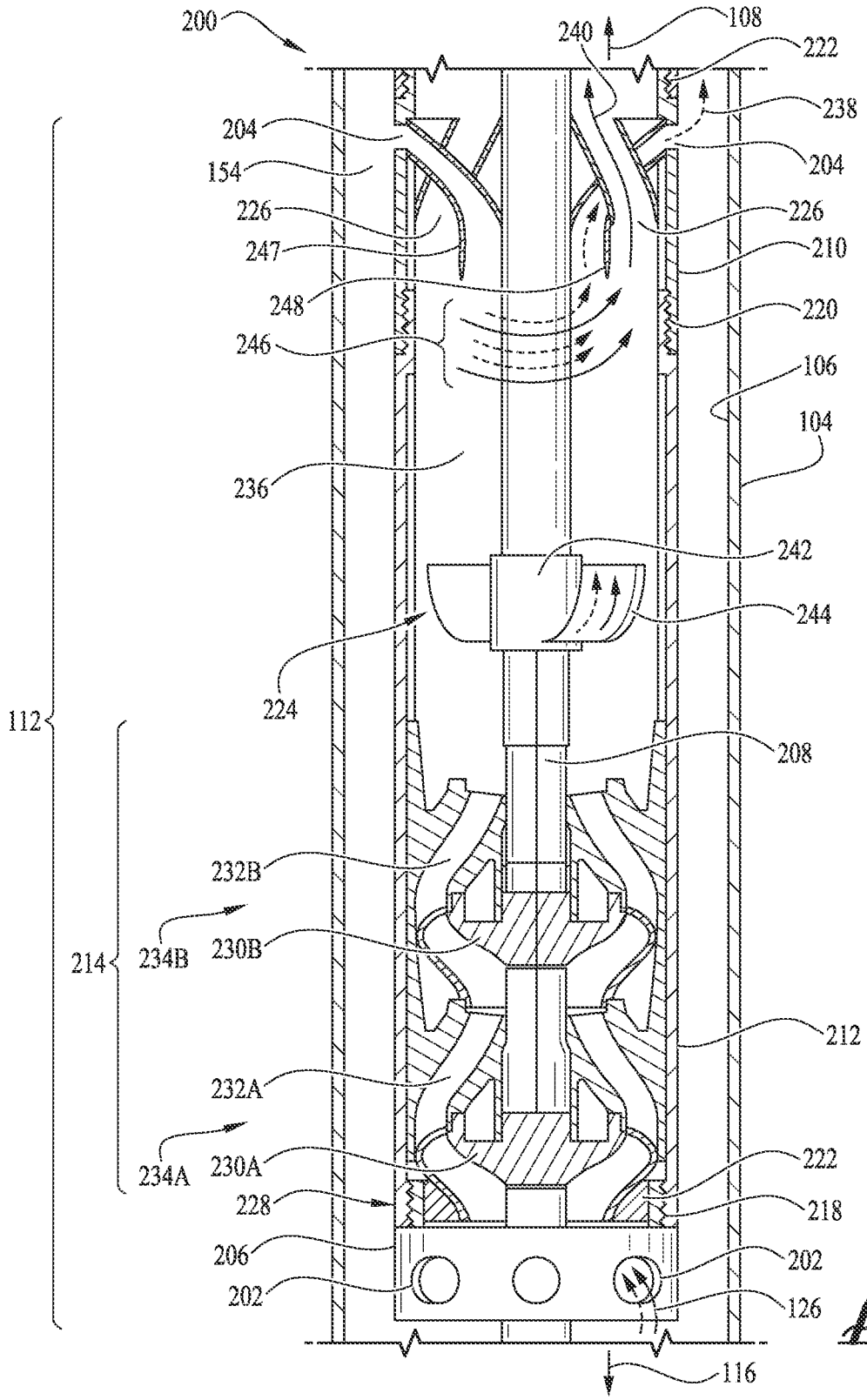
FIG. 2 is an illustration of a gas separator fluid mover assembly according to an embodiment of the disclosure.

Fluid pressure in the wellbore 104 causes production fluid 126 to enter the intake ports, e.g., 202 of FIG. 2, of the gas separator fluid mover assembly 112. Gas separator fluid mover assembly 112 separates a gas phase portion from the liquid phase portion of production fluid 126 before the gas phase enters centrifugal pump assembly 108. In an embodiment, the electric motor 116 may be a two pole, three phase squirrel cage induction motor or any other electric motor operable or configurable to provide rotational power.

Seal unit 114, also referred to as an equalizer assembly and a seal unit assembly, may be a motor protector that serves to equalize pressure and keep motor oil separate from production fluid 126. In one or more embodiments, a production tubing section 122 may couple to the centrifugal pump assembly 108 using one or more connectors 128 or may couple directly to the centrifugal pump assembly 108. In one or more embodiments, any one or more production tubing sections 122 may be mechanically coupled together to extend the ESP assembly 150 into the wellbore 104 to a desired or specified location. Any one or more components of production fluid 126 may be pumped from centrifugal pump assembly 108 through production tubing 122 to the surface 102 for transfer to a storage tank, a pipeline, transportation vehicle, any other storage, distribution or transportation system and any combination thereof.

FIG. 2 is a partial cross-sectional view 200 of the gas separator fluid mover assembly 112 of the ESP assembly 150 described above with reference to FIG. 1. In an embodiment, the gas separator fluid mover assembly 112 comprises a base 206, a cylindrical housing 212, a crossover 210, and a fluid mover 214. The upstream end of the cylindrical housing 212 can be mechanically coupled, e.g., threadingly coupled, to the downstream end of the base 206. The downstream end of the cylindrical housing 212 may be mechanically coupled, e.g., threadingly coupled, to the upstream end of the crossover 210. The base 206 has one or more intake ports 202 which may be disposed or positioned at a distal end of the housing 212. The crossover 210 has one or more discharge ports 204. In one or more embodiments, the one or more intake ports 202 and one or more discharge ports 204 may be disposed or positioned circumferentially about the gas separator fluid mover assembly 112 at a downhole or a distal end and at an uphole or proximal end, respectively, of the gas separator fluid mover assembly 112. The one or more intake ports 202 allow production fluid 126 to enter the gas separator fluid mover assembly 112. The one or more discharge ports 204 allow a gas phase or gas component of the production fluid 126 to be discharged into the annulus 154 formed between the ESP assembly 150 and the casing 106 or wellbore 104. The integrated gas separator fluid mover assembly 112 may couple to one or more other components, for example, to a drive shaft of centrifugal pump assembly 108 via a drive shaft 208 of the gas separator fluid mover assembly 112. The drive shaft of the centrifugal pump assembly 108 may be mechanically coupled to the drive shaft 208 by a coupling sleeve or a coupling hub. The rotational power is transferred from the drive shaft 208 to the drive shaft of the centrifugal pump assembly 108 via the coupling sleeve or a coupling hub. In an embodiment, the drive shaft 208 and drive shaft of the centrifugal pump assembly 108 is a unitary body (e.g., the drive shaft 204 is a continuous body without a connection).

In an embodiment, the gas separator fluid mover assembly 112 may comprise a fluid mover 214, a separation device 224, a separation chamber 236, one or more discharge ports 204 for a gas phase fluid and one or more discharge ports 226 for a liquid phase fluid. The separation device 224 comprises a paddle wheel or similar structure. The fluid mover 214 may be one or more impeller and diffuser systems wherein the impeller is mechanically coupled to the drive shaft 208. The one or more intake ports 202 allow intake of production fluid 126 from annulus 154 into the fluid mover 214 which communicates or flows the fluid 126 to the separation device 224.

In one or more embodiments, fluid mover 214 may comprise a bottom portion 228, one or more impellers 230A and 230B (collectively referred to as impellers 230) and one or more diffusers 232A and 232B (collectively referred to as diffusers 232). The bottom portion 228 can comprise, an entrance sub 222, a first centrifugal pump stage 234A comprising a first impeller 230A and a first diffuser 232A and a second centrifugal pump stage 234B comprising a second impeller 230B and a second diffuser 232B. Although the fluid mover 214 is described as having two centrifugal stages 234A & 234B, it is understood that the fluid mover 214 may have 1, 2, 3, 4, 5, 6, 7, 8, or any number of centrifugal pump stages 234. For example, the bottom portion 228 may comprise a first centrifugal pump stage 234A, a second centrifugal pump stage 234B, a third centrifugal pump stage 234C, and a fourth centrifugal pump stage 234D. The diffusers 232 may be mechanically coupled to the housing 212 of the gas separator fluid mover assembly 112. In one or more embodiments, the fluid mover 214 comprises an impeller 230 without a diffuser 232. Bottom portion 228 of fluid mover 214 may comprise an entrance sub 222 and one or more intake ports 202 for receiving and directing the fluid 126.

The one or more impellers 230 are mechanically coupled to the drive shaft 208 and receive rotational power from the electric motor 116. For example, the impellers may have keyways that mate with a corresponding keyway in the drive shaft 208 and keys may be inserted into the aligned keyways to mechanically couple the impellers to the drive shaft 208. When the ESP assembly 150 is operating (e.g., the electric motor 116 is turning and the drive shaft 208 is turning), the impellers 230 rotate while the one or more diffusers 232 remain stationary. The one or more impellers 230 and the one or more diffusers 232 emulsify or mix the components of the production fluid 126. In one or more embodiments, the drive shaft 208 causes the one or more impellers 230 to spin or rotate to force the fluid 126 through the separation device 224 into the separation chamber 236 where the fluid 126 is separated into a gas phase 238 and a liquid phase 240 as will be described in further detail herein.

In one or more embodiments, the-separation device 224 is disposed or positioned within the housing 212. The separation device 224 comprises a stationary auger, a rotating auger, a closed centrifugal paddle, an open centrifugal paddle, a paddle wheel, or a combination thereof. The separation device 224 may comprise a paddle wheel with at least one vane mechanically attached to a hub mechanically coupled to the drive shaft to induce fluid rotation. The separation device 224 may be a stationary auger with at least one vane engaging an outer sleeve to induce rotational fluid motion. The separation device 224 may be a rotating auger with at least one vane attached to an inner hub mechanically coupled to the drive shaft to induce fluid rotation. The separation device 224 may include a closed centrifugal paddle with at least one vane mechanically attached to a hub that is coupled to the drive shaft and the vane mechanically attached to a cylinder with an allowance fit inside the housing 212. The fluid mover 214 may be positioned at a downhole or distal end of the housing 212. In one or more embodiments, the-separation device 224 and the housing 212 are fluidically coupled to the one or more intake ports 202 (e.g., fluidically coupled to the intake ports 202 via the fluid mover 214). Fluid mover 214 communicates or forces production fluid 126 received at the one or more intake ports 202 through the housing 212, and discharges to the separation device 224.

With reference to the embodiment of the gas separator fluid mover assembly 112 in FIG. 2, the fluid mover 214 may increase the flow rate or velocity of the fluid 126 to increase rotation of the fluid 126 through the separation device 224 to create a more efficient and effective separation of the fluid 126 into a plurality of phases, for example, a liquid phase 240 and a gas phase 238. Centrifugal forces cause the heavier component of the fluid 126, a liquid phase 240, to circulate along an outer perimeter of the separation chamber 236 while the lighter component of the fluid 126, the gas phase 238, is circulated along an inner perimeter of the separation chamber 236. In one or more embodiments, fluid 126 may begin to separate into a gas phase 238 and a liquid phase 240 while flowing through the separation device 224. In one or more embodiments, the liquid phase 240 may comprise residual gas that did not separate into the gas phase 238. However, the embodiments discussed herein reduce this residual gas to protect the centrifugal pump assembly 108 from gas build-up or gas lock. The separation chamber 236 may be said to comprise an annulus formed between an inside of the housing 212 and an outside of the drive shaft 208.

In one or more embodiments, the separated fluid (for example, liquid phase 240 and gas phase 238) is directed to a crossover 210. The crossover 210 may be said to have an inlet that is fluidically coupled to an outlet of the fluid mover 214 (e.g., via fluidically coupled via the separation device 224 and via the separation chamber 236), to have a gas phase discharge port 204 open to the annulus 154 defined between the inside of the wellbore 104 and an outside diameter of the ESP assembly 150, and to have a liquid phase discharge port 226 open to or fluidically coupled to an inlet of the centrifugal pump assembly 108. The crossover 210 may comprise a plurality of channels or define a plurality of channels, for example, a gas phase discharge path 247 (a first pathway) and a liquid phase discharge path 248 (a second pathway). A gas phase 238 of the fluid 126 may be discharged through the gas phase discharge path 247, and a liquid phase 240 of the fluid 126 may be discharged through the liquid phase discharge path 248. In one or more embodiments, gas phase discharge path 247 may correspond to any one or more discharge ports 204. The crossover 210 may be referred to as a gas flow path and liquid flow path separator of the gas separator fluid mover assembly 112. The crossover 210 may be referred to as a flow path separator of the gas separator fluid mover assembly 112 with the understanding that one or more flow paths are liquid flow paths and one or more flow paths are gas flow paths. In one or more embodiments, a portion of the liquid phase 240 of the fluid 126 may be discharged through the gas phase discharge path 247 and subsequently one or more of the discharge ports 204 in response to the liquid phase discharge path 248 being supplied to capacity with the liquid phase 240 of the fluid 126, e.g., the liquid phase discharge path 248 being oversupplied with liquid phase 240.

Figure 3A:
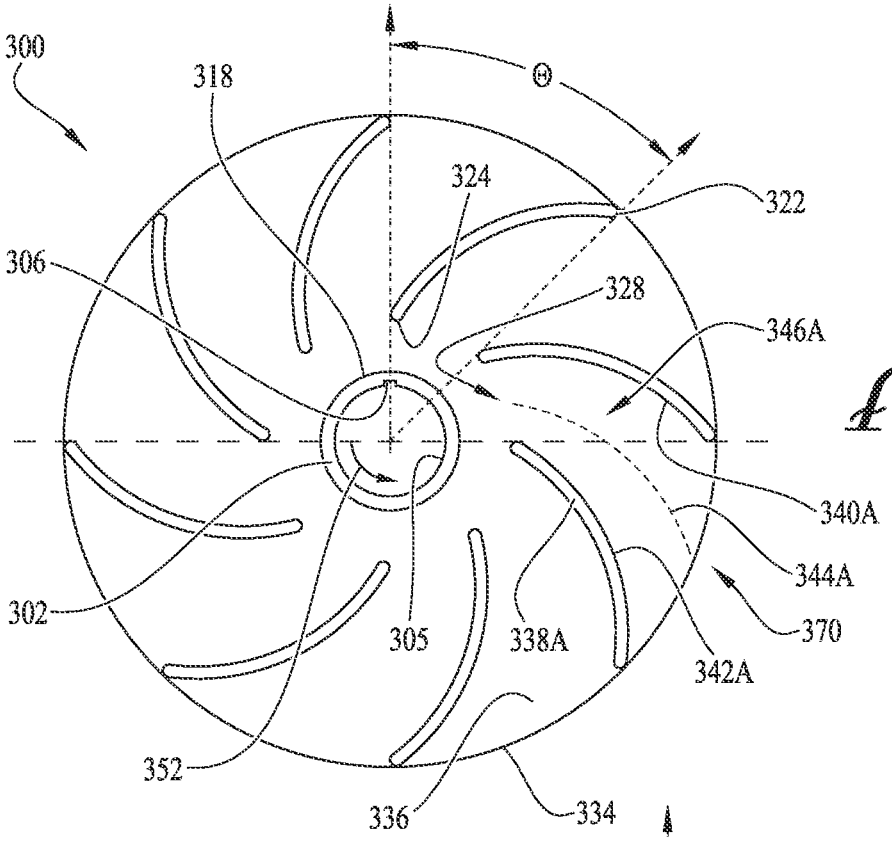
FIG. 3A is a cut-away illustration of a flow path through a typical impeller of a fluid mover in a gas separator fluid mover assembly according to an embodiment of the disclosure.

Turning now to FIG. 3A, a typical impeller 300 for production fluids is described. The impeller 300 is illustrated with an end view of the bottom end or the end oriented in the downhole direction. The impeller 300 may be a unitary construction with passages formed from an inner edge to the outer edge. The unitary construction type may be in the form of a casting, sintering, or metal deposition process. For clarity, the end view of the bottom end of the impeller 300 is described without an outer portion called a shroud. Although the end view appears flat, it is understood that the surfaces may be conical or generally frustoconical in shape and the view may be best described as a projection. The impeller 300 includes features for mechanically coupling the impeller 300 to the drive shaft, e.g., drive shaft 208 of FIG. 2, including a forward hub 302, an outer surface 336, an inner bore 305, and a keyway 306. The modified impeller 300 can be mechanically coupled to the drive shaft, e.g., 208, by one or more keys that mate with the keyway 306 formed inside the inner bore 305 of the forward hub 302 and a keyway in the drive shaft 208. The impeller 300 may have an outer edge 334 bounded by the edge of the shroud as will be described hereinafter. The impeller 300 may comprise 5, 6, 7, or more vanes 338A and flow chambers 346A. The vanes 338A can be walled type structures that attach to the outer surface 336 and extend upward, or outward, to the shroud, as will be described further hereafter. The plurality of vanes 338A may comprise a back surface 340A, a forward surface 342A, a leading edge 324, and a trailing edge 322. The walled structure of the vanes 338A may curve about the outer surface 336 of the hub along a sweep angle theta. The wrap angle theta may be measured from the leading edge 324 to the trailing edge 331A. The impeller 300, a typical impeller, may have 5, 6, 7, 8, or more vanes 338A with a sweep angle theta of 40 to 55 degrees. The impeller 300 may include a flow chamber 346A for each vane 338A. The flow chamber 346A may be bounded by a back surface 340, a forward surface 342, the outer surface 336 of the hub, an inner surface of a shroud, an inlet 328, and an exit 370. The impeller 300 may rotate in a counter clockwise direction as denoted by arrow 352. The rotation of the impeller 300 may induce fluid flow along a flow path 344A from the inlet 328 to the exit 370. It is understood that the flow path is a generalized representation included for clarity of the disclosure.

Figure 3B:
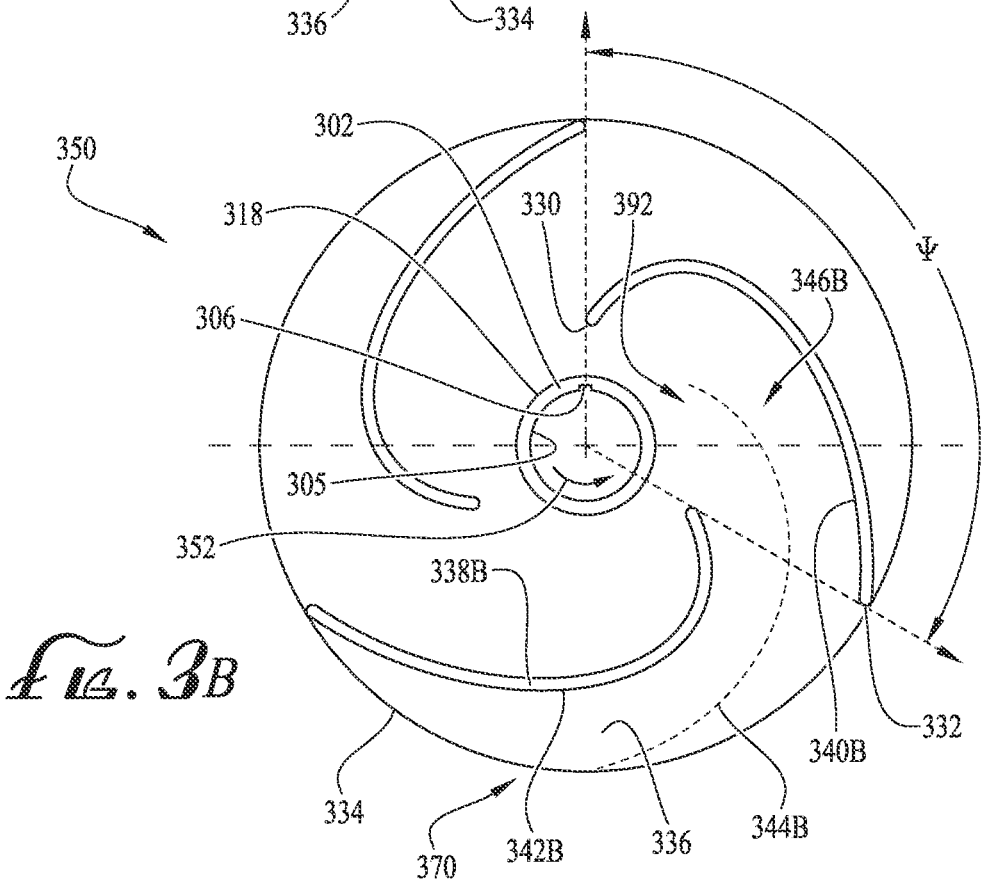
FIG. 3B is an illustration of a flow path through a modified impeller of a fluid mover in a gas separator fluid mover assembly according to an embodiment of the disclosure.

Turning now to FIG. 3B, a modified impeller 350 for production fluids comprising a high viscosity fluid phase liquid and a gas phase liquid, according to one or more embodiments, is described. The modified impeller 350 includes some of the same features as impeller 300 and are labeled similarly. The modified impeller 350 includes a forward hub 302, an outer surface 336, an inner bore 305, and a keyway 306. The modified impeller 350 may have an outer edge 334 bounded by the edge of the shroud as will be described hereinafter. The modified impeller 350 can be used to implement impeller 230 in fluid mover 214.

The modified impeller 350 is illustrated with an end view of the bottom end or the end oriented in the downhole direction. The modified impeller 350 can comprise fluid flow features that reduce the friction loss due to high viscosity fluids. The liquid portion of the production fluids may comprise a viscosity in the range of 500 cp to 12,000 cp, in the range of 100 cp to 600 cp, in the range of 20 cp to 200 cp, or in the range of 100 cp to 2,000 cp. The modified impeller 350 may comprise a reduced number of vanes 338B, flow chambers 346B, and flow paths 344B. The number of flow chambers 346B can be reduced from a typical number, e.g., 5, 6, 7, or 8 to a reduced number of 1, 2, 3, or 4 flow chambers 346B. The vanes 338B can be walled type structures that attach to the outer surface 336 and extend upward, or outward, to the shroud, as will be described further hereafter. The plurality of vanes 338B may comprise a back surface 340B, a forward surface 342B, a leading edge 330B, and a trailing edge 332. The walled structure of the vanes 338B may curve about the outer surface 336 along a sweep angle psi. The sweep angle psi may be measured from the leading edge 330 to the trailing edge 332. The modified impeller 350 may have a reduced number of vanes 338B, e.g., 3, with a sweep angle psi of 100 degrees or more than 100 degrees. The sweep angle psi of the vanes 338B for the modified impeller 350 may range between 150 to 210 degrees, 100 to 240 degrees, 210 to 270 degrees, 240 to 300 degrees, or 180 to 270 degrees. In an embodiment, the sweep angle psi of the vanes 338B for the modified impeller 350 ranges from 100 degrees to 300 degrees.

The modified impeller 350 may include a flow chamber 346B for each vane 338B. The flow chamber 346B may be bounded by a back surface 340, a forward surface 342, the outer surface 336 of the hub, an inner surface of a shroud, an inlet 392, and an exit 370. The modified impeller 350 may rotate in a counter clockwise direction as denoted by arrow 352. The rotation of the modified impeller 350 may induce fluid flow along a flow path 344B from the inlet 392 to the exit 370. The increase in flow area from the reduction of flow paths 344B, the increase in the cross-sectional flow area along the flow path 344B, and the reduction of surface area can reduce the friction losses for production fluids with a high viscosity and thus increase the volumetric flow rate of the production fluids through the modified impeller 350. Although the vanes 338B are illustrated with a clockwise direction when the modified impeller 350 rotates in a counter clockwise direction per arrow 352, it is understood that the vanes 338B of the modified impeller 350 may be manufactured in the counter clockwise direction when the modified impeller 350 rotates in a clockwise direction.

Figure 4:
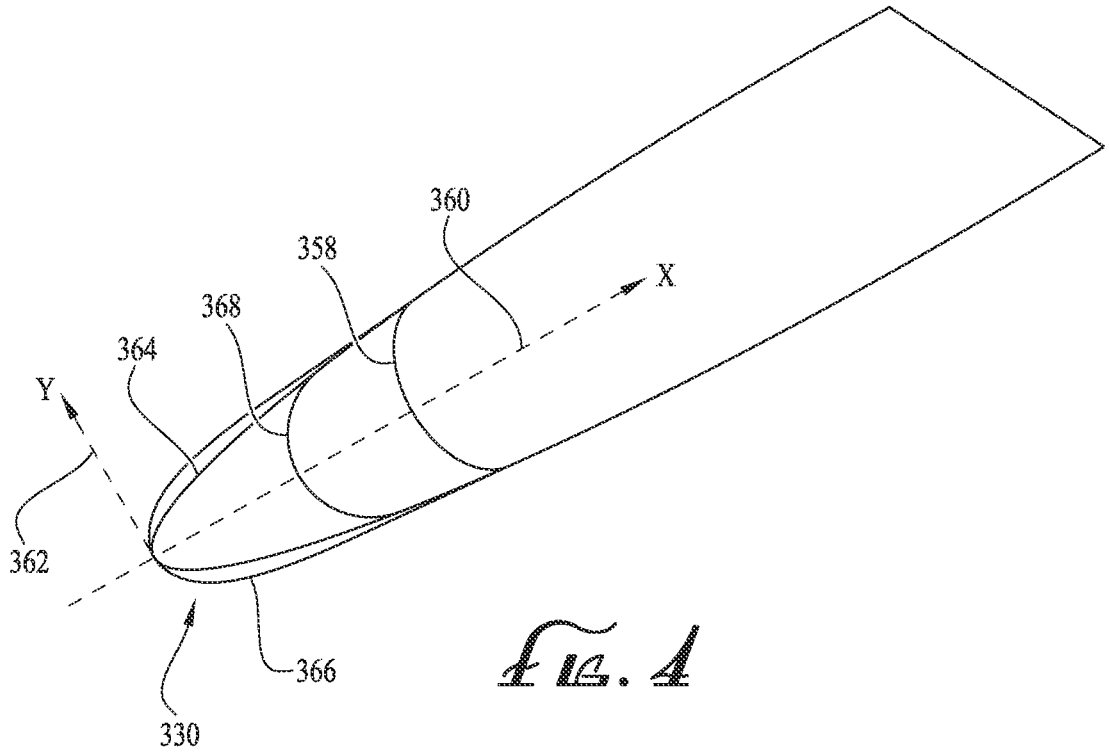
FIG. 4 is an illustration of an inlet profile shape for an inlet of a modified impeller of a fluid mover in a gas separator fluid mover assembly according to an embodiment of the disclosure.

Turning now to FIG. 4, the modified impeller 350 can include an inlet 392 with a profiled surface (e.g., a profiled edge) on the leading edge 330 of the vane 338B. The leading edge 330 of the modified impeller 350 traverses the distance from the outer surface 336 of the forward hub to the inner surface of the shroud. Typically, a leading edge 330 is manufactured with a blunt shape or a semi-circle shape by the process of manufacturing, e.g., casting, as profiling the leading edge 330 is complicated, difficult, and expensive. However, this blunt edge increases the inlet losses with viscous fluid, as it creates a shock and boundary layer separation. An additional manufacturing process can include profiling the shape the leading edge 330 to a sharp edge to reduce the shock losses and prevent or reduce boundary layer separation of the fluid flow. This additional manufacturing requires additional setup time and processes, e.g., machining process or grinding process, that increases the cost by increasing the manufacturing time and, in some cases, special tooling. The leading edge 330 may have a profiled surface in one or more embodiments as illustrated in FIG. 4 to reduce the frictional losses from high viscosity fluids. The profiled surface of the leading edge 330 may have a curvature that can be defined relative to an X-Axis 360 and a Y-Axis 362. The profiled surface may have a parabolic shape 364 wherein the curvature is generally defined by the mathematical equation for parabola, e.g., $y=x^2$. The profiled surface may have an ellipse shape 366 wherein the curvature is generally defined by the mathematical equation for an ellipse: $x^2/a^2-y^2/b^2=1$, where a and b are coefficients that define scaling and geometries of the particular ellipse. As a comparison, the profiled surface is illustrated with a semi-circle shape 368 wherein the radius of curvature is generally defined by the radius being generally half of the circle and a blunt shape 358 wherein the radius of curvature is about a quarter of the thickness of the leading edge 330. The leading edge 330 of the modified impeller 300 preferably has a profiled surface with a parabolic shape 364 or ellipse shape 366.

Figure 5A:
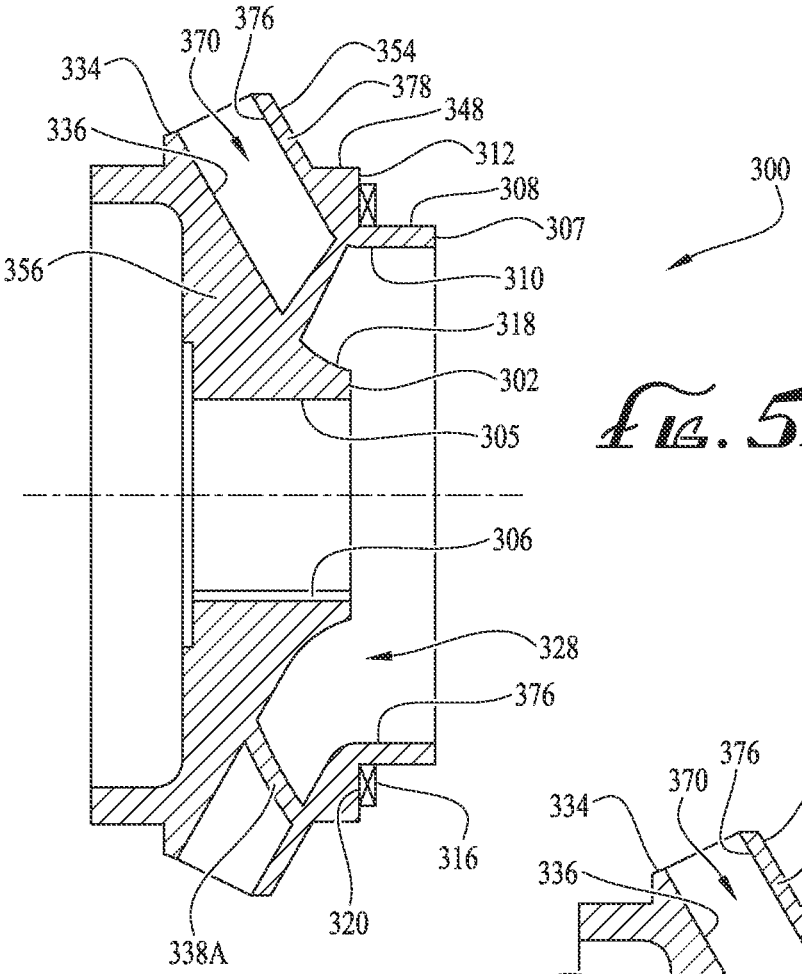
FIG. 5A is a cross-sectional view of a typical impeller of a fluid mover in a gas separator fluid mover assembly according to an embodiment of the disclosure.

Turning now to FIG. 5A, the impeller 300 is shown in a cross-sectional side view to further describe the features. The unitary construction of the impeller 300 may include a hub 356, a shroud 378, and a plurality of vanes 338A. The hub 356 can include a forward hub 302 with an outer surface 318 and an inner bore 305 with a keyway 306. The plurality of vanes 338A can project from the outer surface 336 of the hub to the inner surface 376 of the shroud 378. The shroud 378 can comprise a front surface 320, an outer skirt 312, and an inner skirt 307. The outer skirt 312 may be a cylinder shape projecting outward from the front surface 320 with an outer surface 348 and an inner surface 314. The inner skirt 307 may be a cylinder shape projecting outward from the front surface 320 with an outer surface 308 and an inner surface 310. The inner surface 310 of the inner skirt 307 may transition to the inner surface 376 of the shroud 378. The impeller 300 may have a plurality of flow chambers with an inlet 328 and an exit 370. The flow chambers may be bound by the outer surface 336 of the hub 356, the inner surface 376 of the shroud 378, the forward surface 342 and the back surface 340 of the vanes 338. The inlet 328 for the impeller 300 includes the outer surface 318 of the hub 302 and the inner surface 310 of the inner skirt 307. The length of the inner skirt 307 may be 1.5 inches. The impeller 300 can include one or more thrust washers 316 that contact or abut a similar washer or other wear surface on the mating diffuser to prevent wear on the impeller 300 or the diffuser caused by direct contact between the components. The thrust washer 316 may be in contact with the front surface 320 and retained between the outer surface 308 of the inner skirt 307 and the inner surface 314 of the outer skirt 312. A labyrinth seal may be formed on the front of the impeller 300 between the outer surface 308 of the inner skirt 307, the thrust washer 316, and a mating surface on the diffuser. The thrust washer 316 and the labyrinth seal may provide a pressure seal to contain the increased pressure within the flow chambers. The outer surface 348 of the outer skirt 312 may transition to the outer surface 354 of the shroud 378.

Figure 5B:
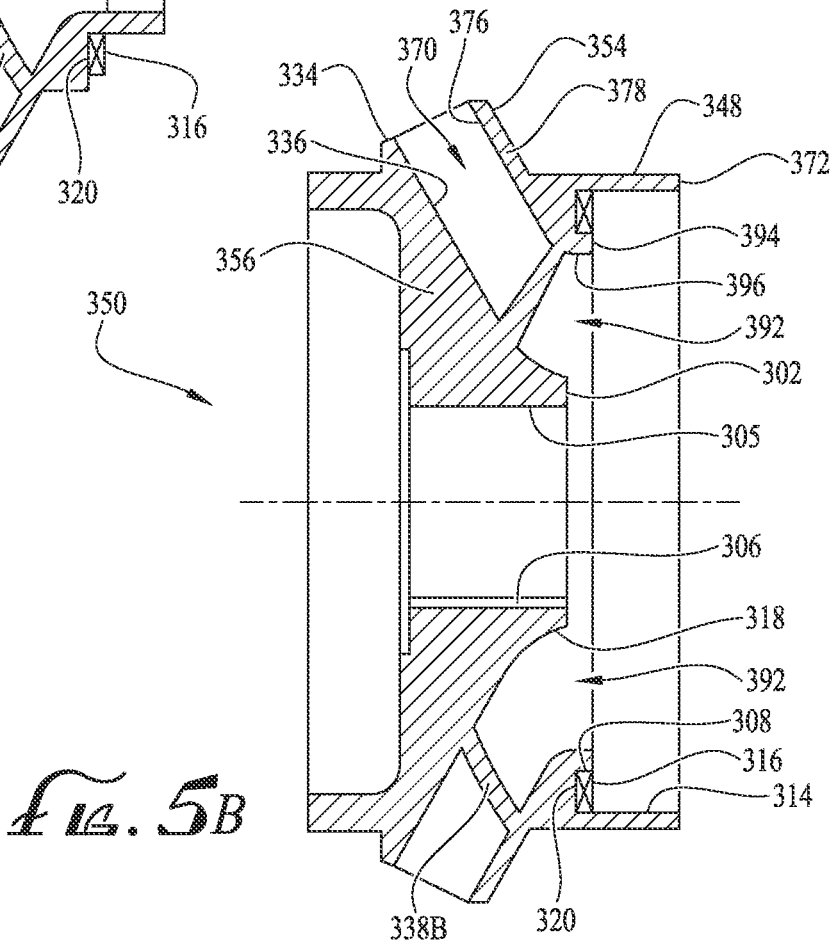
FIG. 5B is a cross-sectional view of a modified impeller of a fluid mover in a gas separator fluid mover assembly according to another embodiment of the disclosure.

The modified impeller 350 may include a modified inlet geometry to reduce the friction losses due to viscous fluids entering the inlet. Turning now to FIG. 5B, the modified impeller 350 is shown in a cross-sectional side view to further describe the features. The unitary construction of the modified impeller 350 may include a hub 356, a shroud 378, and a plurality of vanes 338B. The flow chambers of the modified impeller 350 may begin at the inlet 392 and end at the exit 370. The flow chambers may be bound by the outer surface 336 of the hub 356 and the inner surface 376 of the shroud 378. The hub 356 can include a forward hub 302 with an outer surface 318 and an inner bore 305 with a keyway 306. The plurality of vanes 338B can project from the outer surface 336 of the hub to the inner surface 376 of the shroud 378. The shroud 378 can comprise a front surface 320, an outer skirt 372, and an inner skirt 394. The outer skirt 372 may be a cylinder projecting out from the front surface 320 with an outer surface 348 and an inner surface 314. The inner skirt 394 may shortened to reduce the inner surface 396 in contact with viscous production fluids when compared to the inner skirt 307 of impeller 300 in FIG. 5A. The inner skirt 374 may be shortened to 0.5, 0.6, 0.7, 0.8, 0.9, 1.0, 1.1, 1.2, 1.3, or 1.4 inches. In an alternate embodiment, the inner skirt 394 may be removed. The viscous production fluids entering the inlet 392 of the modified impeller 350 may encounter less surface area from the reduction in inner skirt 394 and thus less friction losses. The production fluids move from the inner surface 396 of the inner skirt 394 to the flow channels that are bound by the inner surface 376 of the shroud 378 and the outer surface 336 of the hub.

The modified impeller 350 can include one or more thrust washers 316 and a labyrinth seal. The thrust washer 316 may contact the front surface 320 and be held in place by a press fit between an inner skirt 394 and an outer skirt 372. A labyrinth seal may be provided by the thrust washer 316, the outer skirt 372, and a mating part on the diffuser. The outer skirt 372 may include an extended or lengthened projection from the front surface 320. The length of the outer skirt 372 may be zero to 0.25 inches on impeller 350 as shown as outer skirt 312 in FIG. 5A. The length of the outer skirt 372 on the impeller 350 may be lengthened to 1.0 inches. The outer skirt 372 may be 0.30, 0.4, 0.5, 0.6, 0.7, 0.8, or 0.9 inches.

Turning back to FIG. 2, the centrifugal pump stage 234 of the fluid mover 214 comprises an impeller 230 and a diffuser 232. The impeller 230 may be a modified impeller 350 of FIGS. 3B and 5B. The diffuser 232 of the centrifugal pump stage may be a modified diffuser with an increased flow chamber area along the flow paths for high viscosity fluids. In some embodiments, the modified diffuser may have a reduced number of vanes of 4 or less. For example, the modified diffuser may have 1, 2, 3, or 4 vanes and flow chambers. The vanes and flow chambers within the modified diffuser may have the same sweep angle as the modified impeller 350. For example, the modified diffuser may have a sweep angle of 100 degrees or more than 100 degrees, such as psi shown in FIG. 3B. The sweep angle of the diffuser may have the same range as the vanes 338B for the modified impeller 350, such as between 150 to 210 degrees, 100 to 240 degrees, 210 to 270 degrees, 240 to 300 degrees, or 180 to 270 degrees. In an embodiment, the sweep angle of the vanes of the modified diffuser may range from 100 degrees to 300 degrees. The vanes and flow chambers within the modified diffuser may have an opposite direction as the vanes 338B and flow chambers 346B of the modified impeller 350. For example, the vanes of the modified diffuser can sweep in the counter-clockwise direction when the vanes 338B of the modified impeller 350 in FIG. 3B sweep in the clockwise direction. The modified diffuser may include an inlet with a profiled surface on the inlet edge. The inlet edge of the modified diffuser traverses the distance from the outer surface hub to the inner surface of the housing. As previously described, the inlet edge can include a profiled surface to reduce the shock losses and prevent or reduce boundary layer separation of the fluid flow. The inlet edge may have a profiled surface in one or more embodiments as illustrated in FIG. 4 such as a parabolic shape 364, an ellipse shape 366, or combination thereof.

In some embodiments, the modified diffuser may have an equal number of vanes, inlets, flow paths, and flow chambers as the modified impeller 350 of FIG. 5B. For example, the modified diffuser may have 3 vanes, 3 inlets, 3 flow paths, and 3 flow chambers when the modified impeller 350 as 3 vanes, 3 inlets, 3 flow paths, and 3 flow chambers. In some embodiments, the modified diffuser may have one more vane, inlet, flow path, and flow chambers than the number of vanes and flow chambers of the modified impeller 350. For example, the modified diffuser may have 4 inlets, 4 flow paths, and 4 flow chambers when the modified impeller 350 as 3 inlets, 3 flow paths, and 3 flow chambers. In an embodiment, the modified diffuser may have one less vane, inlet, flow path, and flow chambers than the number of vanes, inlets, flow paths, and flow chambers of the modified impeller 350.

In an embodiment, the present disclosure teaches providing a second fluid mover comprising one or more centrifugal pump stages, e.g., 234, in the gas separator fluid mover assembly 112 downstream of the crossover 210 and upstream of the inlet of the centrifugal pump assembly 108 to overcome the undesired limiting of fluid flow rates associated with a narrow flow passage in conventional gas separators.

In an embodiment, an ESP pump assembly may have two or more gas separator fluid mover assemblies. For example, the ESP pump assembly 150 in FIG. 1 may comprise a first gas separator fluid mover assembly 112A and a second gas separator fluid mover assembly 112B. The first gas separator fluid mover assembly 112A may couple to the second fluid mover assembly 112B. The second fluid mover assembly 112B may couple to the pump assembly 108. The intake ports 202 of the first gas separator fluid mover assembly 112A may be fluidically coupled to the pump assembly 108 via the second fluid mover assembly 112B. The drive shaft of the pump assembly 108 may be mechanically coupled to the drive shaft of the motor 116 via the first gas separator fluid mover assembly 112A and the second gas separator fluid mover assembly 112B.

Returning to FIG. 1, a centrifugal pump stage, e.g., 234 from FIG. 2, may be used in one or more locations within the ESP assembly 150. In some embodiments, the impeller of the centrifugal pump stage, e.g., 234, may be coupled to the fourth drive shaft within the centrifugal pump assembly 108.

In an embodiment the centrifugal pump assembly 108 comprises one or more centrifugal pump stages, each state comprising an impeller and diffuser. The impeller or diffuser or both may incorporate one or more of the modifications described above.

Additional Disclosure—Part 1

The following are non-limiting, specific embodiments in accordance with the present disclosure:

A first embodiment, which is a centrifugal pump stage for use in a downhole artificial lift assembly, comprising a drive shaft extending through the assembly; an impeller and a diffuser, of the centrifugal pump stage, wherein the impeller is mechanically coupled to the drive shaft, wherein the impeller includes less than five flow chambers, wherein each flow chambers includes an inlet, a flow path, and an exit, wherein the flow chamber inlet includes a profiled edge and an inner surface, and wherein the diffuser comprises at least one more flow path than the impeller; and a pump stage inlet and a pump stage outlet, wherein a flow rate of a production fluid is moved from the pump stage inlet to the pump stage outlet by the centrifugal pump stage, and wherein the production fluid comprises a fluid portion with a viscosity of at least 500 centipoise and a gas fluid portion.

A second embodiment, which is the centrifugal pump stage of the first embodiment, wherein the profiled edge of the inlet includes a parabolic profile, and wherein the inner surface of the flow chamber inlet i) comprises a shortened inner skirt, or ii) does not comprise an inner skirt.

A third embodiment, which is the centrifugal pump stage of the first embodiment or of the second embodiment, wherein the impeller includes an extended outer skirt.

A fourth embodiment, which is the centrifugal pump stage of any of the first through third embodiments, wherein the impeller comprises 1 flow chamber, 2 flow chambers, 3 flow chambers, or 4 flow chambers.

A fifth embodiment, which is the centrifugal pump stage of any of the first through fourth embodiments, further comprising an exit angle on the exit of the impeller; and wherein the exit angle is greater than 45 degrees measured from a back surface of the flow chamber to a tangential surface of a shroud edge.

A sixth embodiment, which is the centrifugal pump stage of any of the first through fifth embodiments, wherein the centrifugal pump stage is part of an ESP assembly.

A seventh embodiment, which is the centrifugal pump stage of any of the first through sixth embodiments, wherein the centrifugal pump stage is a primary pump coupled to the drive shaft located downstream of a gas separator fluid mover assembly.

An eighth embodiment, which is the centrifugal pump stage of any of the first through seventh embodiments, wherein the centrifugal pump stage is a first fluid mover coupled to the drive shaft located within the gas separator fluid mover assembly.

A ninth embodiment, which is the centrifugal pump stage of any of the first through eighth embodiments, wherein the centrifugal pump stage is a second fluid mover coupled to the drive shaft located downstream of the first fluid mover within a gas separator fluid mover assembly.

Additional Disclosure—Part 2

A first embodiment, which is a downhole gas separator fluid mover assembly, comprising a drive shaft extending through the assembly; a first fluid mover comprising a first centrifugal pump stage having an inlet and an outlet, wherein a flow rate of a production fluid is moved from the inlet to the outlet by the fluid mover, and wherein the production fluid comprises a high viscosity fluid portion with a viscosity of at least 200 centipoise and a gas fluid portion; an impeller and a diffuser, of the centrifugal pump stage, wherein the impeller is mechanically coupled to the drive shaft, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller; a first fluid separation device located downstream of the fluid mover having an inlet and an outlet, wherein the inlet is fluidically coupled to the outlet of the first centrifugal pump stage, and wherein the first separation device produces a fluid motion generating a separation of viscous liquid and gas; a separation chamber concentrically disposed around the drive shaft and located downstream of the device generating a flow separation, wherein an inside surface of the separation chamber and an outside surface of the drive shaft define an annulus that is fluidically coupled to the device generating a flow separation; and a flow path separator located downstream of the separation chamber and having an inlet fluidically coupled to the annulus, having a gas phase discharge port open to an exterior of the assembly, and having a liquid phase discharge port.

A second embodiment, which is the downhole gas separator fluid mover assembly of the first embodiment, wherein the profiled edge of the inlet includes a parabolic profile, and wherein the inner surface of the flow chamber inlet i) comprises a shortened inner skirt, or ii) does not comprise an inner skirt.

A third embodiment, which is the downhole gas separator fluid mover assembly of the first embodiment or of the second embodiment, wherein the impeller includes an extended outer skirt.

A fourth embodiment, which is the downhole gas separator fluid mover assembly of any of the first through third embodiments, wherein the first fluid separation device comprises a stationary auger, a rotating auger, a closed centrifugal paddle, an open centrifugal paddle, a paddle wheel, or a combination thereof, mechanically coupled to the drive shaft or a stationary auger.

A fifth embodiment, which is the downhole gas separator fluid mover assembly of any of the first through fourth embodiments, wherein the impeller comprises 1 flow chamber, 2 flow chambers, 3 flow chambers, or 4 flow chambers.

A sixth embodiment, which is the downhole gas separator fluid mover assembly of any of the first through fifth embodiments, wherein a portion of the high viscosity fluid passes through the gas phase discharge port in response to an over-supply of high viscosity fluid to the liquid phase discharge port in response to the flow rate of the production fluid through the first fluid mover.

A seventh embodiment, which is the downhole gas separator fluid mover assembly of any of the first through the sixth embodiments, wherein the impeller has a sweep angle of fin the range from 100 degrees to 300 degrees.

An eighth embodiment, which is the downhole gas separator fluid mover assembly of any of the first through the seventh embodiments, wherein the diffuser includes less than five flow chambers.

A ninth embodiment, which is the downhole gas separator fluid mover assembly of the eighth embodiment, wherein each flow chamber of the diffuser includes an inlet that has a profiled edge.

A tenth embodiment, which a method of lifting liquid in a wellbore, comprising running an ESP assembly comprising a gas separator fluid mover assembly and a centrifugal pump assembly into the wellbore; receiving a reservoir fluid into an inlet of the gas separator fluid mover assembly, wherein the reservoir fluid comprises gas phase fluid and liquid phase fluid; moving the reservoir fluid downstream within the gas separator fluid mover assembly by a first fluid mover of the gas separator fluid mover assembly, wherein the first fluid mover has a fluid inlet and a fluid exit, wherein the first fluid mover comprises one or more first centrifugal pump stages, wherein each first centrifugal pump stage comprises an impeller and a diffuser, wherein the impeller is mechanically coupled to a drive shaft, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller; inducing, by a separation device, rotational motion of the reservoir fluid within a separation chamber by a flow rate of the reservoir fluids from the fluid exit of the first fluid mover; receiving the reservoir fluid with the rotational motion into an inlet of a flow path separator of the gas separator fluid mover assembly from the separation device; separating at least some of the gas phase fluid from the reservoir fluid by the flow path separator of the gas separator fluid mover assembly to yield separated gas in the gas flow path and separated liquid in the liquid flow path; venting the at least some of the gas phase fluid by the flow path separator out of the gas separator fluid mover assembly via a gas phase discharge port of the flow path separator into an annulus defined between an interior of the wellbore and an exterior of the gas separator fluid mover assembly; and flowing the at least some of the reservoir fluid, received via a liquid phase discharge port of the flow path separator, out a discharge of the centrifugal pump assembly via a production tubing to a surface location.

An eleventh embodiment, which is the method of the tenth embodiment, wherein the impeller comprises 1 flow chamber, 2 flow chambers, 3 flow chambers, or 4 flow chambers.

A twelfth embodiment, which is the method of the tenth embodiment or of the eleventh embodiment, wherein the inner surface of the flow chamber inlet i) comprises a shortened inner skirt, or ii) does not comprise an inner skirt.

A thirteenth embodiment, which is the method of any of the tenth through twelfth embodiments, wherein the profiled edge comprises a parabolic profile or an ellipse profile.

An fourteenth embodiment, which is the method of any of the tenth through thirteenth embodiments, further comprising receiving the reservoir fluid by a second fluid mover of the gas separator fluid mover assembly from the first fluid mover, wherein the second fluid mover is located downstream of the flow path separator, wherein the second fluid mover is fluidically connected to the first fluid mover via the liquid phase discharge port of the flow path separator, wherein the second fluid mover comprises one or more second centrifugal pump stages, wherein each second centrifugal pump stage comprises an impeller and a diffuser, wherein the impeller is rotationally coupled to the drive shaft, and wherein the impeller has less than 5 flow chambers; inducing a rotational motion of the reservoir fluid by a second separation device, wherein the second separation device is located downstream of the second fluid mover; and wherein the second separation device is fluidically coupled to the second fluid mover; moving the reservoir fluid downstream within the gas separator fluid mover assembly by the second fluid mover to a second separation chamber, wherein the second separation chamber is located downstream of the second separation device and upstream of the flow path separator, wherein the flow path separator receives the reservoir fluid from the first fluid mover via the second fluid mover, the second separation device, and second the separation chamber; separating at least some of the gas phase fluid from the reservoir fluid by the flow path separator to yield separated gas in the gas flow path and separated liquid in the liquid flow path; venting the at least some of the separated gas in the gas flow path via a gas phase discharge port of a second flow path separator into the annulus; and flowing the least some of the reservoir fluid out of the liquid phase discharge port.

A fifteenth embodiment, which is the method of any of the tenth through fourteenth embodiments, further comprising venting the at least some of the separated liquid by the flow path separator via a gas discharge port of the flow path separator into the annulus in response to a liquid phase discharge port of the flow path separator being over supplied with the separated liquid by the flow path separator.

A sixteenth embodiment, which is the method of any of the tenth through fifteenth embodiments, wherein the diffuser includes less than five flow chambers.

A seventeenth embodiment, which is the method of any of the tenth through sixteenth embodiments, wherein the diffuser comprises flow chambers and each flow chamber of the diffuser includes an inlet that has a profiled edge.

An eighteenth embodiment, which is a downhole gas separator fluid mover assembly, comprising a drive shaft extending through the assembly; a first housing surrounding a portion of the drive shaft; a base coupled to an upstream end of the first housing and having a plurality of inlet ports; a first fluid mover mechanically coupled to the drive shaft, located downstream of the base, located within the first housing, having an inlet fluidically coupled to the plurality of inlets of the base, and having an outlet; a separation chamber concentrically disposed around the drive shaft, located within the first housing, and located downstream of the first fluid mover, wherein an inside surface of the separation chamber and an outside surface of the drive shaft define an annulus that is fluidically coupled to the outlet of the first fluid mover; a flow path separator mechanically coupled at an upstream end to a downstream end of the first housing, located downstream of the fluid mover, having an inlet fluidically coupled to the first annulus, having a gas phase discharge port open to an exterior of the assembly, and having a liquid phase discharge port; a second fluid mover mechanically coupled to the drive shaft, located downstream of the flow path separator, and having an inlet fluidically coupled to a fluid phase discharge port of the flow path separator; and wherein the first fluid mover comprises one or more first centrifugal pump stages comprising an impeller mechanically coupled to the drive shaft and a diffuser, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller.

A nineteenth embodiment, which is the downhole gas separator fluid mover assembly of the eighteenth embodiment, wherein the impeller comprises 1 flow chamber, 2 flow chambers, 3 flow chambers, or 4 flow chambers.

A twentieth embodiment, which is the downhole gas separator fluid mover assembly of the eighteenth embodiment or of the nineteenth embodiment, wherein the inner surface of the flow chamber inlet i) comprises a shortened inner skirt, or ii) does not comprise an inner skirt.

A twenty-first embodiment, which is the downhole gas separator fluid mover assembly of any of the eighteenth through twentieth embodiments, wherein the impeller includes an extended outer skirt.

A twenty-second embodiment, which is the downhole gas separator fluid mover assembly of any of the eighteenth through twenty-first embodiments, wherein the second fluid mover comprises one or more second centrifugal pump stages, wherein each second centrifugal pump stage comprises an impeller mechanically coupled to the drive shaft and a diffuser, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller.

A twenty-third embodiment, which is the downhole gas separator fluid mover assembly of any of the eighteenth through twenty-second embodiments, further comprising a separation device downstream of the first fluid mover and upstream of the separation chamber, wherein the first separation device produces a fluid motion in response to a flow rate of a production fluid from the first fluid mover via the plurality of inlet ports, and wherein the separation device comprises a stationary auger, a rotating auger, a closed centrifugal paddle, an open centrifugal paddle, a paddle wheel, or a combination thereof, mechanically coupled to the drive shaft or a stationary auger.

A twenty-fourth embodiment, which is the downhole gas separator fluid mover assembly of any of the eighteenth through twenty-third embodiments, further comprising a second housing that is mechanically coupled at an upstream end to a downstream end of the flow path separator, wherein the second fluid mover is located within the second housing, and wherein the inlet of the second fluid mover comprises an annulus formed between an outside of the drive shaft and an inside of the second housing.

A twenty-fifth embodiment, which is a centrifugal pump stage for use in a downhole artificial lift assembly, comprising: an impeller and a diffuser, of the centrifugal pump stage, wherein the impeller is mechanically coupled to a drive shaft of the downhole artificial lift assembly that passes through the impeller and the diffuser, wherein the impeller and diffuser includes less than five flow chambers, wherein each flow chamber includes an inlet, a forward surface, a back surface, and an exit, wherein the flow chamber inlet includes a profiled edge and an inner surface; and a pump stage inlet and a pump stage outlet.

A twenty-sixth embodiment, which is the centrifugal pump stage of the twenty-fifth embodiment, wherein the profiled edge of the inlet includes a parabolic profile, an ellipse profile, or a combination thereof.

A twenty-seventh embodiment, which is the centrifugal pump stage of the twenty-fifth embodiment or of the twentieth-sixth embodiment, wherein the inner surface of the flow chamber inlet i) comprises a shortened inner skirt, or ii) does not comprise an inner skirt.

A twenty-eighth embodiment, which is the centrifugal pump stage of any of the twenty-fifth through twenty-seventh embodiments, wherein the impeller includes an extended outer skirt.

A twenty-ninth embodiment, which is the centrifugal pump stage of any of the twenty-fifth through twenty-eighth embodiments, wherein the impeller comprises 1 flow chamber, 2 flow chambers, 3 flow chambers, or 4 flow chambers.

A thirtieth embodiment, which is the centrifugal pump stage of any of the twenty-fifth through twenty-ninth embodiments, wherein the diffuser comprises 1 flow chamber, 2 flow chambers, 3 flow chambers, or 4 flow chambers.

A thirty-first embodiment, which is the centrifugal pump stage of any of the twenty-fifth through thirtieth embodiments, wherein the impeller and diffuser may have different number of flow channel than each other.

A thirty-second embodiment, which is the centrifugal pump stage of any of the twenty-fifth through thirty-first embodiments, wherein the centrifugal pump stage is part of an ESP assembly.

A thirty-third embodiment, which is the centrifugal pump stage of any of the twenty-fifth through thirty-second embodiments, wherein the centrifugal pump stage is a primary pump coupled to the drive shaft located downstream of a gas separator fluid mover assembly.

A thirty-fourth embodiment, which is the centrifugal pump stage of any of the twenty-fifth through thirty-third embodiments, wherein the centrifugal pump stage is disposed in a first fluid mover within a gas separator fluid mover assembly.

A thirty-fifth embodiment, which is the centrifugal pump stage of any of the twenty-fifth through thirty-fourth embodiments, wherein the centrifugal pump stage is disposed in a second fluid mover located downstream of a first fluid mover within a gas separator fluid mover assembly.

A thirty-sixth embodiment, which is the centrifugal pump stage of any of the twenty-fifth through thirty-fifth embodiments, wherein the impeller has a sweep angle of fin the range from 100 degrees to 300 degrees.

A thirty-seventh embodiment, which is the centrifugal pump stage of any of the twenty-fifth through thirty-sixth embodiments, wherein the diffuser includes less than five flow chambers.

A thirty-eighth embodiment, which is the centrifugal pump stage of any of the twenty-fifth through thirty-seventh embodiment, wherein the diffuser comprises flow chambers and wherein each flow chamber of the diffuser includes an inlet that has a profiled edge.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A downhole gas separator fluid mover assembly, comprising:

a drive shaft extending through the assembly;

a first housing surrounding a portion of the drive shaft;

a first fluid mover mechanically coupled to the drive shaft, located within the first housing, having an inlet and having an outlet;

a separation chamber concentrically disposed around the drive shaft, located within the first housing, and located downstream of the first fluid mover, wherein an inside surface of the separation chamber and an outside surface of the drive shaft define an annulus that is fluidically coupled to the outlet of the first fluid mover;

a flow path separator mechanically coupled at an upstream end to a downstream end of the first housing, located downstream of the fluid mover, having an inlet fluidically coupled to the first annulus, having a gas phase discharge port open to an exterior of the assembly, and having a liquid phase discharge port;

a second fluid mover mechanically coupled to the drive shaft, located downstream of the flow path separator, and having an inlet fluidically coupled to the liquid phase discharge port of the flow path separator; and wherein the first fluid mover comprises one or more first centrifugal pump stages comprising an impeller mechanically coupled to the drive shaft and a diffuser, wherein the impeller includes less than four flow chambers, wherein each flow chamber includes an inlet, a flow path, and an exit, wherein the flow chamber inlet includes a profiled edge and an inner surface, wherein the impeller has a sweep angle of in the range from 180 degrees to 300 degrees, and wherein the diffuser comprises at least one more flow path than the impeller, and the diffuser comprises one more flow chamber than the impeller includes.

2. The downhole gas separator fluid mover assembly of claim 1, wherein the inner surface of the flow chamber inlet i) comprises a shortened inner skirt, or ii) does not comprise an inner skirt.

3. The downhole gas separator fluid mover assembly of claim 1, wherein the impeller includes an extended outer skirt.

4. The downhole gas separator fluid mover assembly of claim 1, wherein the second fluid mover comprises one or more second centrifugal pump stages, wherein each second centrifugal pump stage comprises an impeller mechanically coupled to the drive shaft and a diffuser, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller.

5. The downhole gas separator fluid mover assembly of claim 1, further comprising a separation device downstream of the first fluid mover and upstream of the separation chamber, wherein the first separation device produces a fluid motion in response to a flow rate of a production fluid from the first fluid mover via the plurality of inlet ports, and wherein the separation device comprises a stationary auger, a rotating auger, a closed centrifugal paddle, an open centrifugal paddle, a paddle wheel, or a combination thereof, mechanically coupled to the drive shaft or a stationary auger.

6. The downhole gas separator fluid mover assembly of claim 1, wherein the impeller has a sweep angle of in the range from 180 degrees to 270 degrees.

7. The downhole gas separator fluid mover assembly of claim 1, wherein the impeller has a sweep angle of in the range from 210 to 270 degrees.

8. The downhole gas separator fluid mover assembly of claim 1, wherein the impeller has a sweep angle of in the range from 240 to 300 degrees.

9. The downhole gas separator fluid mover assembly of claim 1, wherein the impeller includes less than four flow chambers.

10. A method of lifting liquid in a wellbore, comprising:

running an ESP assembly comprising a gas separator fluid mover assembly and a centrifugal pump assembly into the wellbore, wherein the gas separator fluid mover assembly comprises a drive shaft extending through the assembly;

a first housing surrounding a portion of the drive shaft;

a first fluid mover mechanically coupled to the drive shaft, located within the first housing, having an inlet and having an outlet;

a separation chamber concentrically disposed around the drive shaft, located within the first housing, and located downstream of the first fluid mover, wherein an inside surface of the separation chamber and an outside surface of the drive shaft define an annulus that is fluidically coupled to the outlet of the first fluid mover;

a flow path separator mechanically coupled at an upstream end to a downstream end of the first housing, located downstream of the fluid mover, having an inlet fluidically coupled to the first annulus, having a gas phase discharge port open to an exterior of the assembly, and having a liquid phase discharge port;

a second fluid mover mechanically coupled to the drive shaft, located downstream of the flow path separator, and having an inlet fluidically coupled to the liquid phase discharge port of the flow path separator; and wherein the first fluid mover comprises one or more first centrifugal pump stages comprising an impeller mechanically coupled to the drive shaft and a diffuser, wherein the impeller includes less than four flow chambers, wherein each flow chamber includes an inlet, a flow path, and an exit, wherein the flow chamber inlet includes a profiled edge and an inner surface, wherein the impeller has a sweep angle of in the range from 180 degrees to 300 degrees, and wherein the diffuser comprises at least one more flow path than the impeller and the diffuser comprises one more flow chamber than the impeller includes, receiving a reservoir fluid into an inlet of the gas separator fluid mover assembly, wherein the reservoir fluid comprises gas phase fluid and liquid phase fluid;

moving the reservoir fluid downstream within the gas separator fluid mover assembly by the first fluid mover of the gas separator fluid mover assembly;

inducing, by the first fluid separation device, rotational motion of the reservoir fluid within the separation chamber;

receiving the reservoir fluid into an inlet of the flow path separator of the gas separator fluid mover assembly from the separation device;

separating at least some of the gas phase fluid from the reservoir fluid within the separation chamber to yield separated gas in the gas flow path and separated liquid in the liquid flow path;

venting the at least some of the gas phase fluid by the flow path separator out of the gas separator fluid mover assembly via the gas phase discharge port of the flow path separator into an annulus defined between an interior of the wellbore and an exterior of the gas separator fluid mover assembly; and flowing the at least some of the reservoir fluid, received by the centrifugal pump assembly from the liquid phase discharge port of the flow path separator, out a discharge of the centrifugal pump assembly via a production tubing to a surface location.

11. The method of claim 10, wherein the inner surface of the flow chamber inlet i) comprises a shortened inner skirt, or ii) does not comprise an inner skirt.

12. The method of claim 10, wherein the impeller includes an extended outer skirt.

13. The method of claim 10, wherein the second fluid mover comprises one or more second centrifugal pump stages, wherein each second centrifugal pump stage comprises an impeller mechanically coupled to the drive shaft and a diffuser, wherein the impeller includes less than five flow chambers, wherein each flow chamber includes an inlet, a flow path, and an exit, wherein the flow chamber inlet includes a profiled edge and an inner surface, and wherein the diffuser comprises at least one more flow path than the impeller.

14. The method of claim 10, further comprising a separation device downstream of the first fluid mover and upstream of the separation chamber, wherein the first separation device produces a fluid motion in response to a flow rate of a production fluid from the first fluid mover via the plurality of inlet ports, and wherein the separation device comprises a stationary auger, a rotating auger, a closed centrifugal paddle, an open centrifugal paddle, a paddle wheel, or a combination thereof, mechanically coupled to the drive shaft or a stationary auger.

15. The method of claim 10, wherein the impeller has a sweep angle of in the range from 180 to 270 degrees.

16. The method of claim 10, wherein the impeller has a sweep angle of in the range from 210 to 270 degrees.

17. The method of claim 10, wherein the impeller has a sweep angle of in the range from 240 to 300 degrees.

18. The method of claim 10, wherein the impeller includes less than four flow chambers.

* * * * *